US006109071A

United States Patent [19]

Tsai

[11] Patent Number: 6,109,071

[45] Date of Patent: Aug. 29, 2000

[54] TRANSMISSION MECHANISMS OF NEEDLE PLATFORM AND WEFT SEAT OF KNITTING MACHINE

[76] Inventor: Ming-Hong Tsai, 108 Tor Nun Road, Pei Tou Township, Chan Hua Hsien, Taiwan

[21] Appl. No.: 09/397,082

[22] Filed: Sep. 16, 1999

[51] Int. Cl.[7] ..... D04B 23/00

[52] U.S. Cl. ..... 66/204; 66/84 R; 66/82 A; 74/25

[58] Field of Search ..... 66/84 R, 204, 66/82 A; 74/25

[56] References Cited

U.S. PATENT DOCUMENTS

| | | | |
|---|---|---|---|
| 229,487 | 6/1880 | Townsend et al. | 66/84 R |
| 1,165,294 | 12/1915 | Springthorpe | 66/204 |
| 2,427,395 | 9/1947 | Kellog | 66/204 |
| 2,941,386 | 6/1960 | Held | 66/204 |
| 3,677,034 | 7/1972 | Simpson | 66/84 R |
| 4,852,370 | 8/1989 | Tasler et al. | 66/203 |

*Primary Examiner*—Andy Falik
*Attorney, Agent, or Firm*—Bacon & Thomas, PLLC

[57] ABSTRACT

A transmission mechanism of a needle platform of a knitting machine is provided with a three-way master transmission shaft and two three-way slave transmission shafts which are provided with an eccentric actuation seat which is connected with the needle platform by a connection rod in conjunction with a radial bearing. A transmission mechanism of a weft seat of the knitting machine is provided with a transmission wheel, a fastening seat, an eccentric shaft, and actuation crank for bringing about an eccentric motion to convert the transmission power into a linear motion.

5 Claims, 9 Drawing Sheets

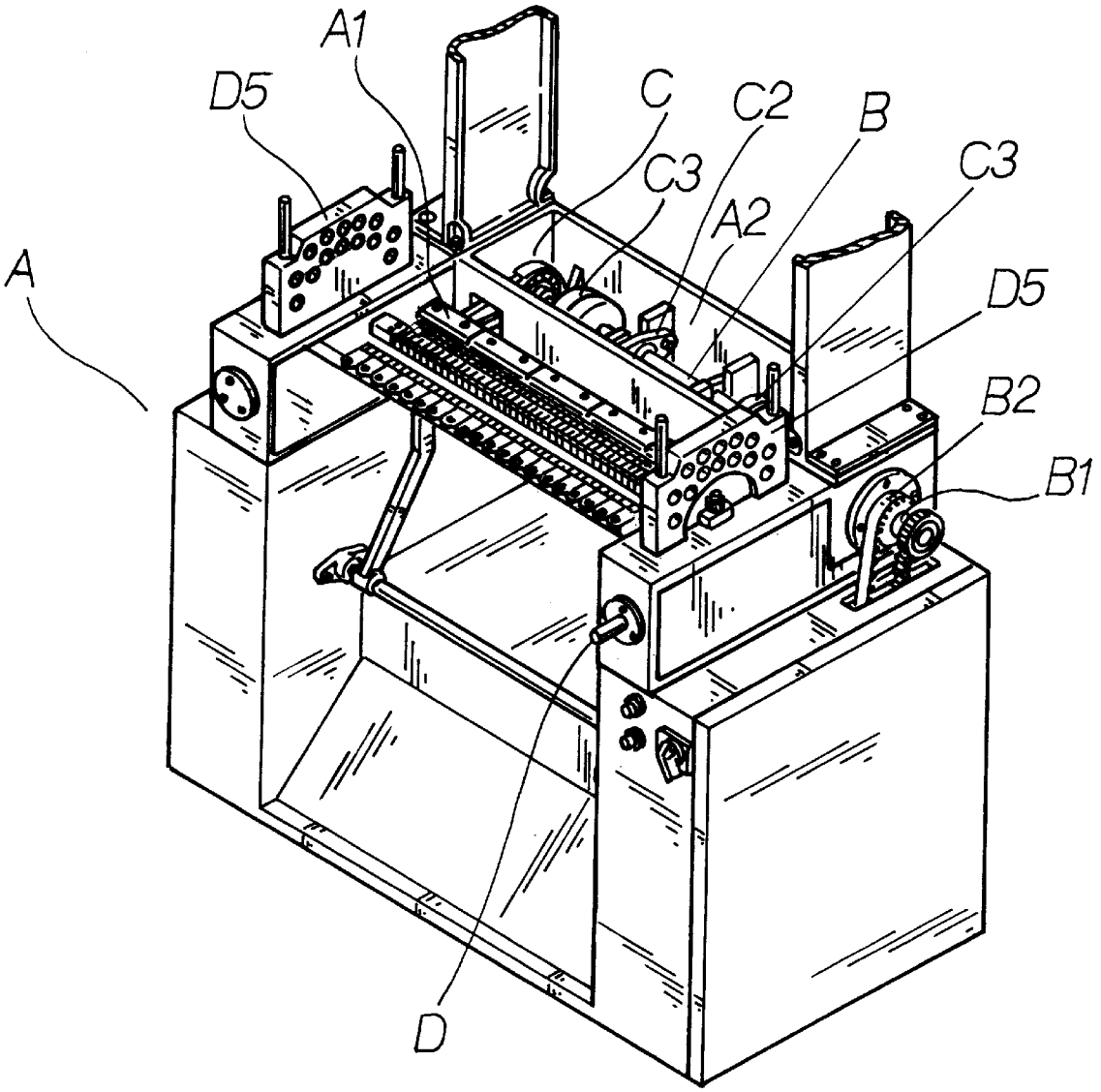
FIG. 1—A (PRIOR ART)

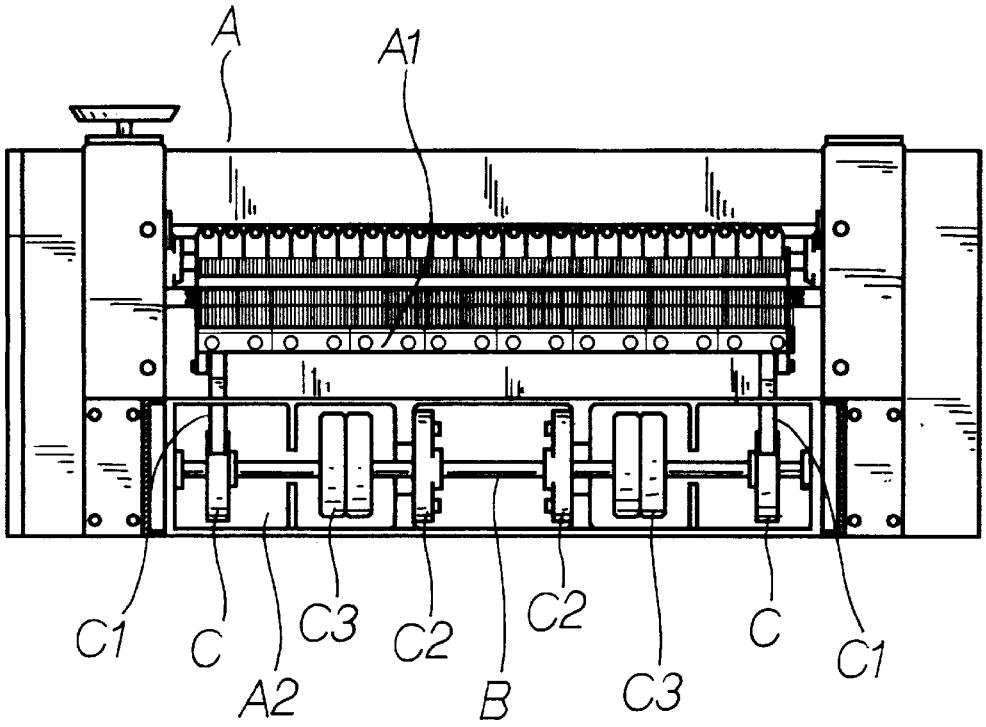
FIG.1-B(PRIOR ART)
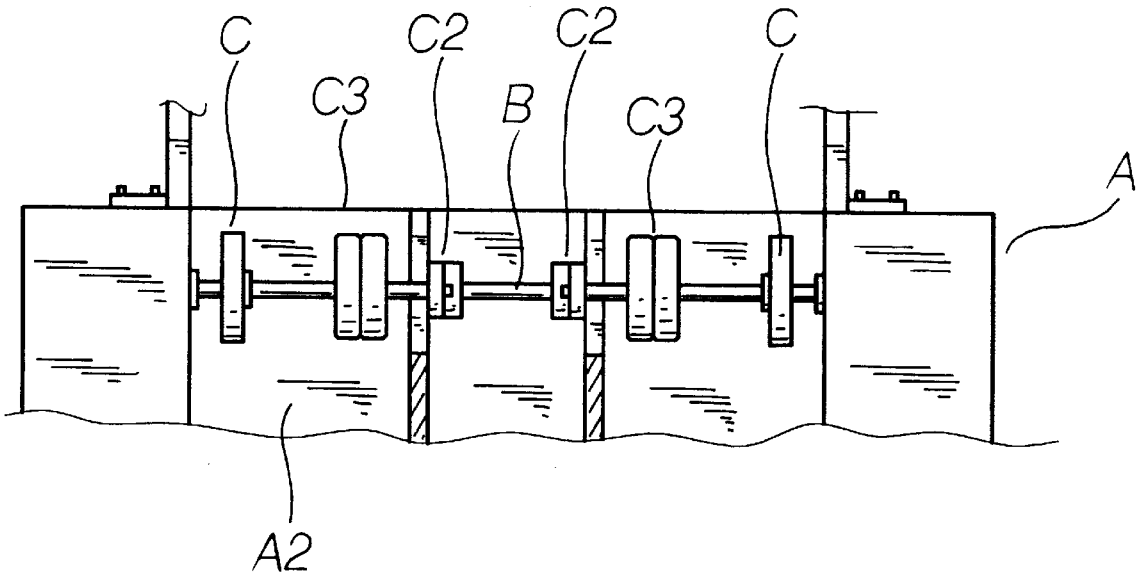
FIG.1-C(PRIOR ART)

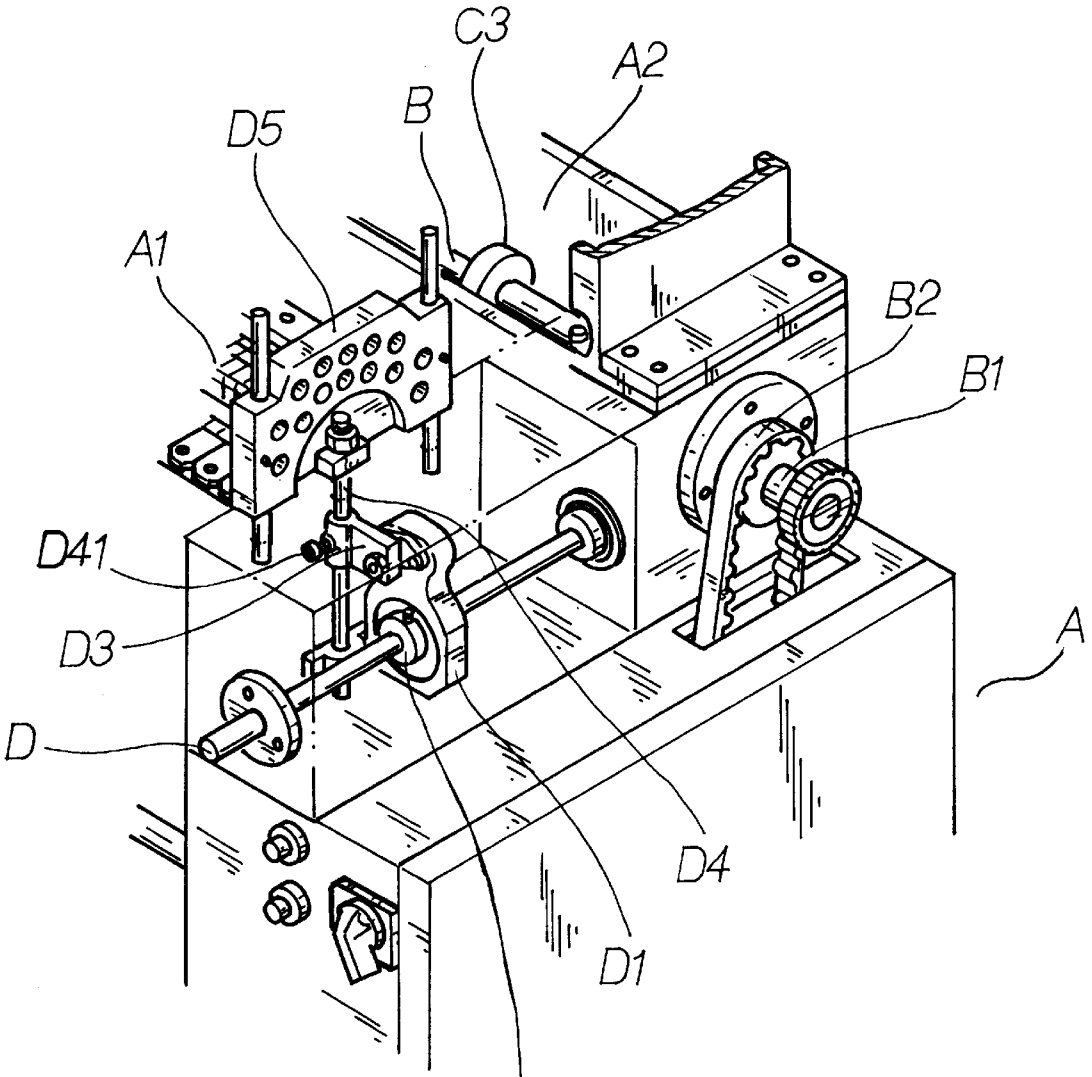
FIG. 1–D(PRIOR ART)

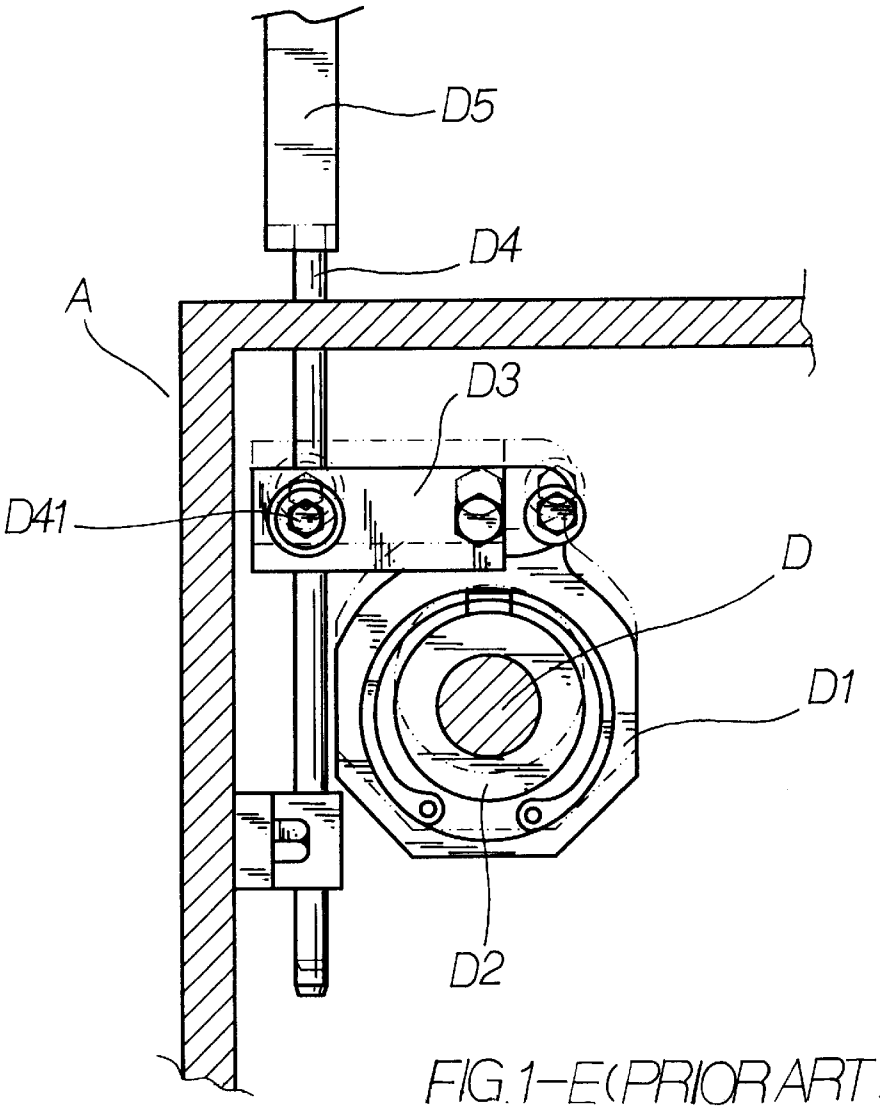
FIG. 1-E (PRIOR ART)

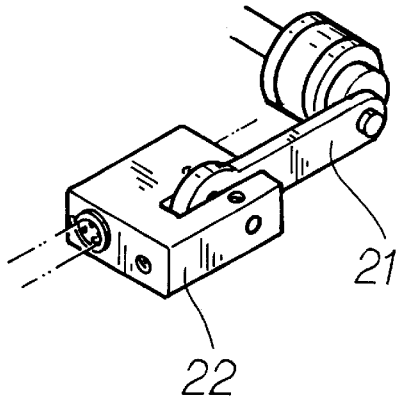
FIG. 2—B
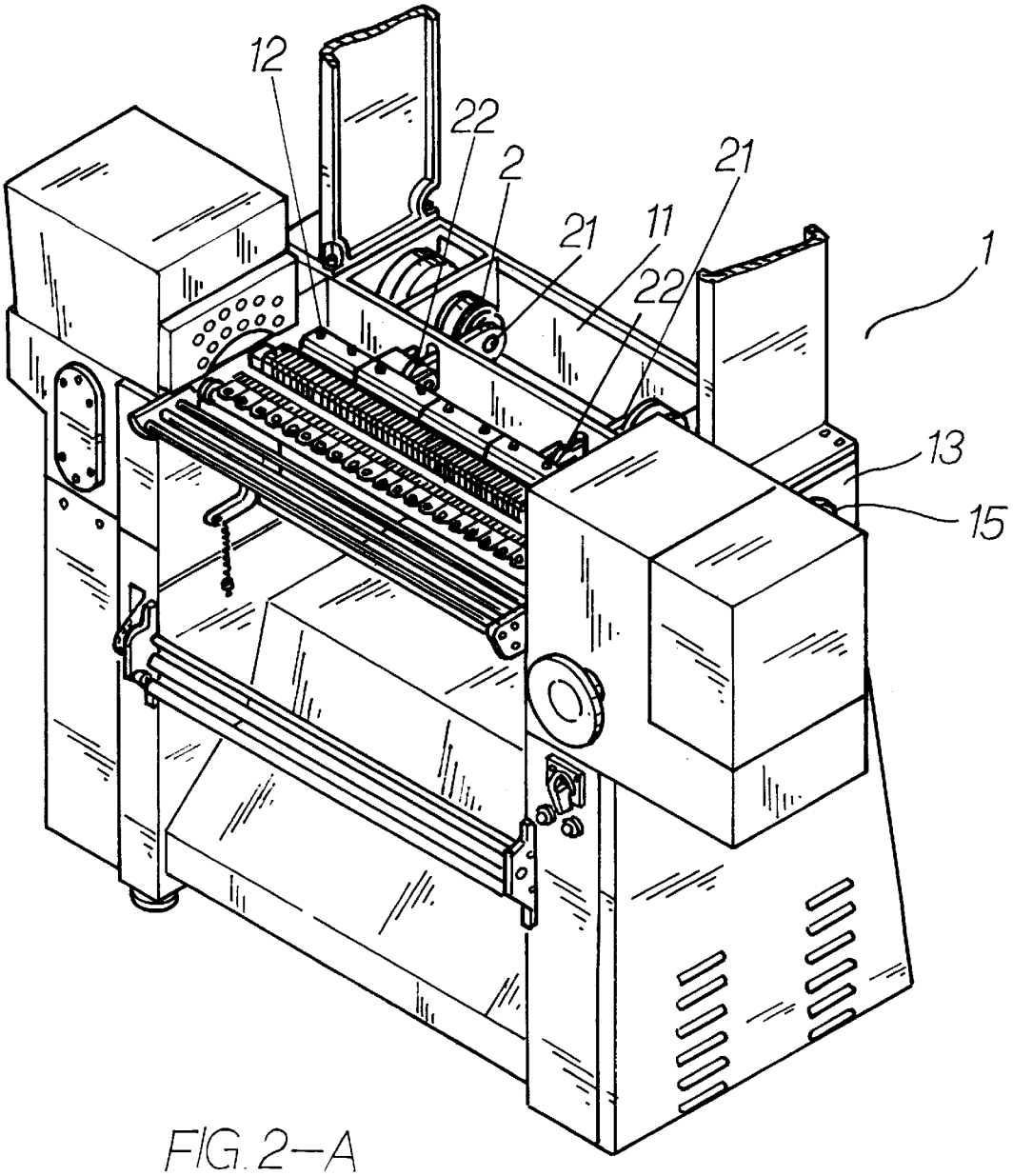
FIG. 2—A

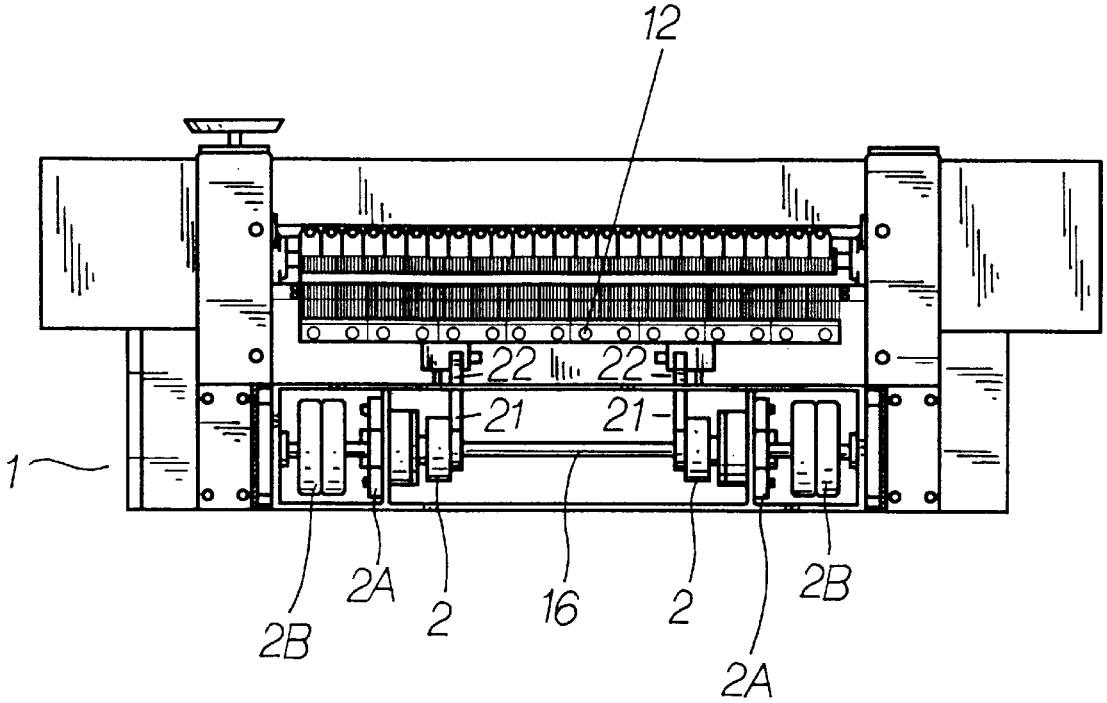
FIG. 3–A
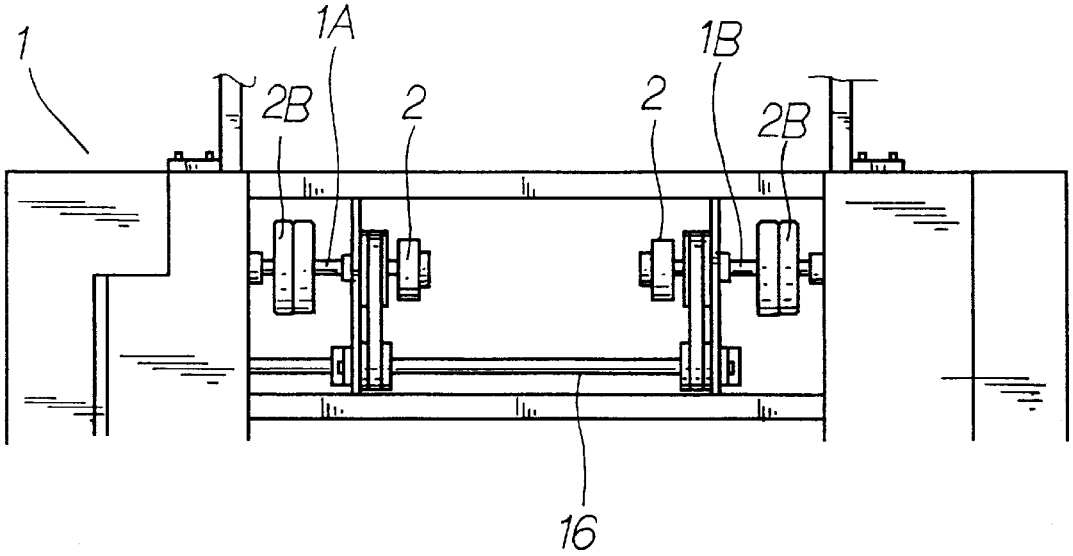
FIG. 3–B

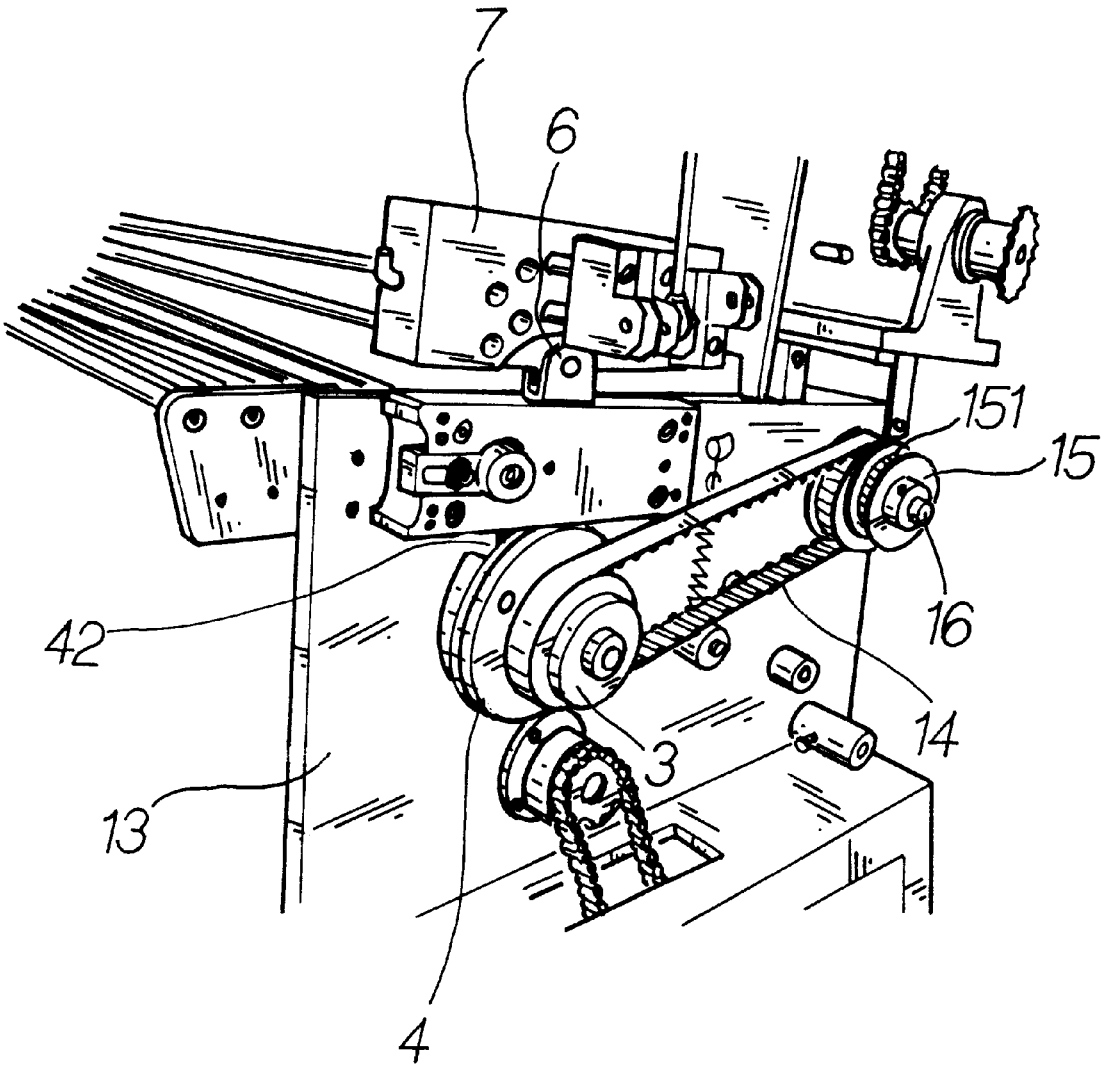
FIG. 4–A

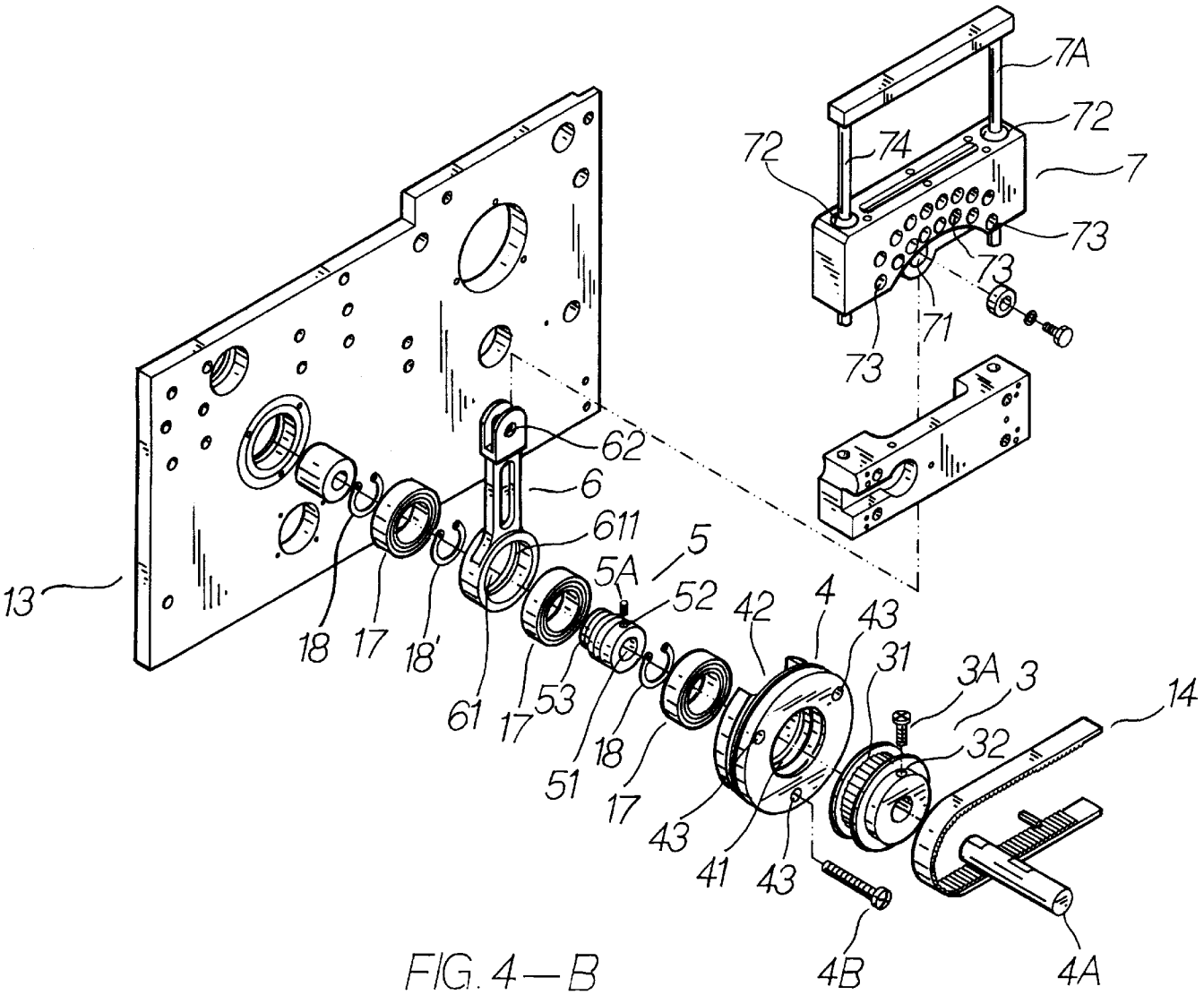
FIG. 4—B

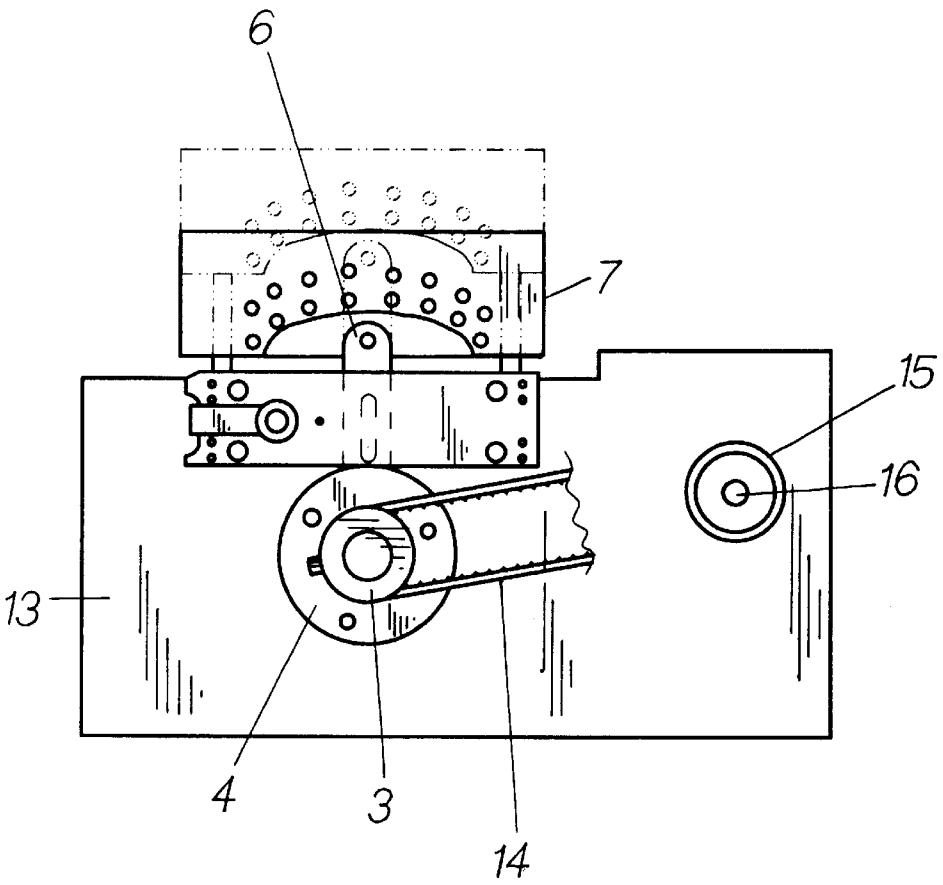
FIG. 4–D
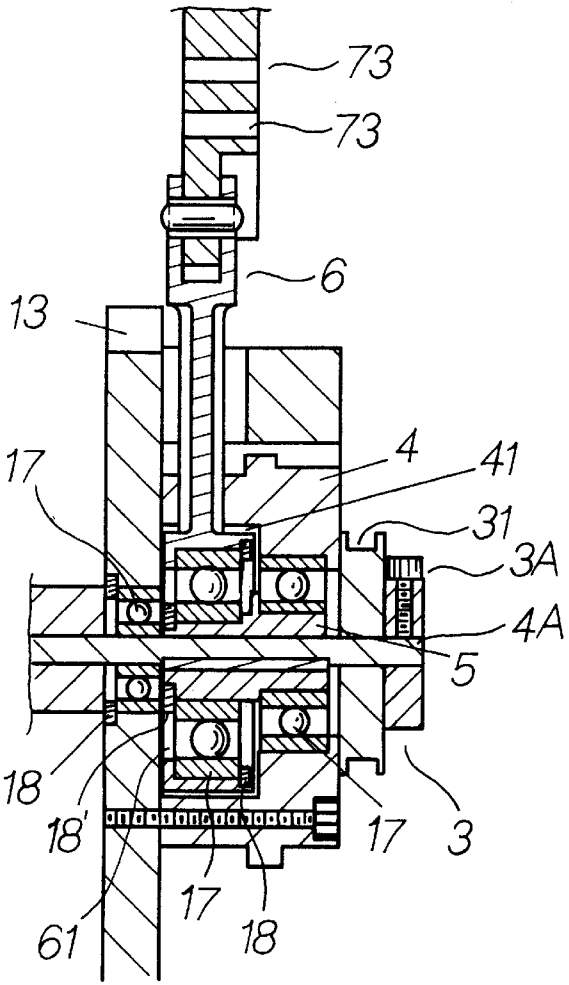
FIG. 4–C

TRANSMISSION MECHANISMS OF NEEDLE PLATFORM AND WEFT SEAT OF KNITTING MACHINE

FIELD OF THE INVENTION

The present invention relates generally to a knitting machine, and more particularly to a transmission mechanism of a needle platform and a weft seat of the knitting machine.

BACKGROUND OF THE INVENTION

As shown in FIGS. 1-A, 1-B, and 1-C, the conventional knitting machine comprises a machine base A on which a needle platform A1 is mounted. Located behind the needle platform A1 is an oil tank A2 in which a transmission shaft B is located. The transmission shaft B is provided at one end thereof with a transmission wheel B1 for transmitting power of the motor in conjunction with a belt B2. The transmission shaft B is provided at both ends thereof with an actuation seat C of an eccentric construction and having a connection rod C1 which is connected with the needle platform A1 in conjunction with the support of a bearing seat C2. The transmission shaft B must be further provided with a plurality of bearing seats C2 and weighted blocks C3, so as to enable the transmission shaft B and the actuation seat C to engage in a fast back-and-forth motion to bring about the knitting operation. The transmission shaft B is always kept in the oil tank A2 which is sealed off to prevent the loss of oil. After a prolonged operation, the actuation seats C must be detached from the transmission shaft B for maintenance or repair work. It is rather time-consuming to dismount and mount the actuation seats C. In addition, the actuation seats C are connected with the needle platform A1 by the connection rod C1, the mechanical friction between the actuation seat C and the connection rod C1 is unavoidable. In other words, the actuation seats C are prone to wear. As a result, the linear motions of the actuation seats an the needle platform A1 are distorted.

Now referring to FIGS. 1-D and 1-E, the conventional transmission mechanism of a weft seat of a knitting machine comprises a transmission rod D, which is fitted into an eccentric shaft cylinder D2 located at the lower portion of a link seat D1 which is fastened at the upper portion thereof with a fastening member D3 which is in turn fastened with a link rod D4 by a bolt D41. The link rod D4 is connected with a weft seat D5 which is provided with a plurality of cross rods connecting a yarn guiding plate. The power of motor is transmitted to the link seat D1 via the transmission rod D. The link seat D1 is driven to engage in a fast up-and-down reciprocating motion, thanks to the operation of the eccentric shaft cylinder D2. The link rod D4 and the weft seat D5 are thus actuated by the fastening member D3. It is therefore readily apparent that the conventional transmission mechanism of the weft seat D5 of the knitting machine is composed of many component parts and is thus inefficient. In addition, the component parts must be often checked to make sure that they are in a proper working condition. Moreover, the transmission mechanism of the weft seat D5 is too complicated in construction and is therefore not cost-effective.

SUMMARY OF THE INVENTION

The primary objective of the present invention is to provide the transmission mechanisms of the needle platform and the weft seat of a knitting machine. The power of motor is transmitted from the master transmission shaft to two slave transmission shafts which are provided with an eccentric actuation seat. The needle platform is connected with the actuation seat via a connection rod. The two slave transmission shafts are provided with a plurality of bearing seats and the weighted blocks. The transmission power is transformed into the linear motion by the transmission wheel of the weft seat in conjunction with the fastening seat, the eccentric shaft, and the crank.

The features and the functions of the present invention will be more readily understood upon a thoughtful deliberation of the following detailed description of the present invention with reference to the accompanying drawings.

BRIEF DESCRIPTION OF THE DRAWINGS

FIG. 1-A shows a perspective view of a transmission mechanism of the prior art.

FIG. 1-B shows a top view of a needle platform transmission mechanism of the prior art.

FIG. 1-C shows a rear view of the needle platform transmission mechanism of the prior art.

FIG. 1-D shows a schematic view of a weft seat transmission mechanism of the prior art.

FIG. 1-E shows a schematic view of the weft seat transmission mechanism of the prior art in action.

FIG. 2-A shows a perspective view of the present invention.

FIG. 2-B shows a schematic view of the actuation seat of the needle platform of the present invention.

FIG. 3-A shows a top view of the needle platform transmission mechanism of the present invention.

FIG. 3-B shows a rear view of the needle platform transmission mechanism of the present invention.

FIG. 4-A shows a schematic view of the weft seat of the present invention.

FIG. 4-B shows an exploded view of the weft seat of the present invention.

FIG. 4-C shows a sectional view of the weft seat of the present invention.

FIG. 4-D shows a schematic view of the weft seat of the present invention in action.

DETAILED DESCRIPTION OF THE INVENTION

As shown in FIGS. 2-A, 2-B, 3-A, and 3-B, the transmission mechanisms of the needle platform and the weft seat of a knitting machine comprise a needle platform transmission mechanism and the weft seat transmission mechanism.

The needle platform transmission mechanism is to transmit the power of motor to a master transmission shaft 16 of a knitting machine 1. The master transmission shaft 16 is disposed in a receiving through 11 and is provided at both ends thereof with a left slave transmission shaft 1A and a right slave transmission shaft 1B. These two slave transmission shafts 1A and 1B are provided with an eccentric actuation seat 2, which is connected with a needle platform 12 by a connection rod 21 and a radial bearing 22. The slave transmission shafts 1A and 1B are provided therein with a plurality of bearing seats 2A and a plurality of weighted blocks 2B. In view of the above three-way master transmission shaft 16 and the fastening of the slave transmission shafts 1A and 1B, as shown in FIGS. 3-A and 3-B, the master transmission shaft 16 and the slave transmission shafts 1A and 1B can be separately dismounted for maintenance or repair work. In light of the actuation seat 2 being connected with the needle platform 12 by the connection rod 21 in conjunction with the radial bearing 22, as shown in FIG. 2-B, the connection rod 21 of the actuation seat 2 is capable of a fast back-and-forth motion.

As shown in FIGS. 4-A, 4-B, and 4-C, the weft seat transmission mechanism of the knitting machine 1 is composed of a transmission wheel 3, a timing belt 14, a fastening set 4, an eccentric shaft 5, a bearing fitting member 17, and an actuation crank 6. The transmission wheel 3 is provided with teeth 31 and is linked with the master transmission wheel 15 by the timing belt 14. The transmission wheel 3 is provided at the center thereof with a connection pin 4A, and a treaded hole 32 which is engaged with a bolt 3A. The master transmission wheel 15 is provided with teeth 151 and is connected with a master transmission shaft 16 which transmits the power of motor to the master transmission wheel 15. The fastening seat 4 is provided with a hole 41, an indentation 42, and a plurality of threaded holes 43 which are engaged with the bolts 4B. A plurality of bearing fitting members 17 and actuation cranks 6 are disposed in the hollow interior of the fastening seat 4. The eccentric shaft 5 is located in an inner ring 61 which is located under the fastening seat 4 and the actuation crank 6. The inner ring 61 has a shallow circular groove 611 in which a bearing fitting member 18. The eccentric shaft 5 is provided with a shallow circular groove 53 in which another C-shaped retaining member 18' is disposed. A connection pin 4A is received in the axial hole 51 of the eccentric shaft 5 which is provided with a threaded hole 52 which is engaged with a bolt 5A. The actuation crank 6 is provided with an axial hole 62. The weft seat 7 is provided at both ends thereof with a through hole 72 in which a guide rod 7A is received for confining the weft seat 7. The weft seat 7 is further provided with a plurality of cross through holes 73, and cross rods.

As shown in FIG. 4-C, the power of motor is transmitted to the master transmission wheel 15 via the master transmission shaft 16. The motion is then imparted form the master transmission wheel 15 to the transmission wheel 3 via the timing belt 14, thereby causing the connection pin 4A to actuate the eccentric shaft 5 to engage in an eccentric motion. In view of the eccentric shaft 5 being connected with the actuation crank 6, the actuation crank 6 is engaged in an up-and-down reciprocating motion, as shown in FIG. 4-D. As a result, the weft seat 7 is actuated to engage in a similar reciprocating motion.

What is claimed is:

1. A transmission mechanism of a needle platform of a knitting machine comprising a master transmission shaft for transmitting power of a motor of the knitting machine to two slave transmission shafts linked with said master transmission shaft, said two slave transmission shafts provided with an eccentric actuation seat fastened therewith such that said actuation seat is connected by a connection rod and a radial bearing for connection with the needle platform of the knitting machine, said two slave transmission shafts further provided with a plurality of bearing seats and weighted blocks.

2. A transmission mechanism of a weft seat of a knitting machine comprising a transmission wheel, a timing belt, a fastening set, an eccentric shaft, a bearing fitting member, and an actuation crank, said transmission wheel provided with teeth and linked with a master transmission wheel by said timing belt, said transmission wheel provided at a center thereof with a connection pin and a threaded hole which is engaged with a bolt, said master transmission wheel provided with teeth and connected with a master transmission shaft for transmitting power of a motor of the knitting machine to said master transmission wheel, said fastening seat provided with a hole, an indentation, and a plurality of threaded holes which are engaged with bolts, said fastening, seat provided in a hollow interior thereof with a plurality of bearing fitting members and actuation cranks, said eccentric shaft being located in an inner ring which is located under said fastening seat and said actuation crank, said inner ring provided with a circular groove for receiving a bearing fitting member in conjunction with a C-shaped retaining member, said eccentric shaft provided with a circular groove for receiving another C-shaped retaining ring, said eccentric shaft provided with an axial hole for receiving a connection pin, and said actuation crank provided with an axial hole.

3. The transmission mechanism as defined in claim 1, wherein said radial bearing is located in said connection rod of said actuation seat to fasten with the needle platform.

4. The transmission mechanism as defined in claim 2, wherein said eccentric shaft converts the transmission power into a linear motion.

5. The transmission mechanism as defined in claim 2, wherein said weft seat is provided at both ends thereof with a through hole and a guide rod received in said through hole of said weft seat for confining said weft seat, said weft seat being further provided with a plurality of cross through holes and cross rods.

* * * * *